United States Patent [19]

Kearns

[11] 4,142,963

[45] Mar. 6, 1979

[54] PENETRATION ENHANCED FLUID MIXING METHOD FOR THERMAL HYDROCARBON CRACKING

[75] Inventor: James D. Kearns, Charleston, W. Va.

[73] Assignee: Union Carbide Corporation, New York, N.Y.

[21] Appl. No.: 804,224

[22] Filed: Jun. 7, 1977

[51] Int. Cl.[2] ..... C10G 9/36

[52] U.S. Cl. ..... 208/129; 208/48 Q; 208/130

[58] Field of Search ..... 208/48 Q, 128, 129, 208/130, 683 R

[56] References Cited

U.S. PATENT DOCUMENTS

| | | | |
|---|---|---|---|
| 2,750,420 | 6/1956 | Hepp | 208/130 |
| 3,419,632 | 12/1968 | Sogawa et al. | 260/683 R |
| 3,855,339 | 12/1974 | Hosoi et al. | 260/683 R |

*Primary Examiner*—Herbert Levine

*Attorney, Agent, or Firm*—Gerald R. O'Brien, Jr.

[57] ABSTRACT

Thermal cracking of hydrocarbons by the introduction of liquid feedstock into a stream of hot gaseous combustion products, the method comprising introducing and mixing said liquid as at least one stream in said hot gaseous combustion product stream while concurrently surrounding and shrouding each of said liquid streams with a co-injected annular stream of gas having a velocity sufficient to supplement momentum without substantial dilution of the combustion product stream.

12 Claims, 6 Drawing Figures

PENETRATION ENHANCED FLUID MIXING METHOD FOR THERMAL HYDROCARBON CRACKING

The present invention relates to an improved mixing method for reactants in a process for the thermal cracking of hydrocarbons.

In the "Advanced Cracking Reaction" (ACR) process, a stream of hot gaseous combustion products is developed in a first stage zone. The hot gaseous combustion products may be developed by the burning of a wide variety of fluid fuels (e.g. gaseous, liquid and fluidized solids) in an oxidant and in the presence of superheated steam. The hydrocarbon feedstock to be cracked is then injected and mixed into the hot gaseous combustion product stream in a second stage zone to effect the cracking reaction. Upon quenching in a third stage zone the combustion and reaction products are then separated from the stream.

In such a process, it has been found essential to achieving proper reaction results that efficient gas/liquid phase mixing be effected to provide the required contact between the two reacting phases.

Heretofore, many attempts have been made to improve such gas/liquid phase mixing in such a process, but such prior attempts have encountered limitations. One such prior mixing process is disclosed in U.S. Pat. No. 3,855,339 by Hosoi et al. In that process, the angle of injection of the liquid phase hydrocarbon into the hot gaseous combustion product stream was controlled to enhance more efficient mixing. An angle of injection of the liquid phase into the hot gaseous combustion product stream of between 120°–150° was maintained. Improved mixing results were limited by the attainable degree of penetration of the liquid stream into the hot gaseous combustion product stream.

It is the prime object of the present invention to enhance the degree of penetration and consequent mixing attainable over that of the methods of the prior art.

In accordance with the present invention, a method is provided, in the thermal cracking of hydrocarbons by the introduction of liquid petroleum feedstock into a stream of hot gaseous combustion products formed by the combustion of fluid fuel and oxidant in the presence of steam, in apparatus having a combustion/mixing zone and a reaction zone downstream therefrom, comprising introducing and mixing said liquid as at least one stream in said hot gaseous combustion products stream while concurrently surrounding each of said liquid streams with a co-injected annular shroud stream of gas having a velocity sufficient to supplement momentum without significant dilution of the combustion product stream (i.e. preferably not exceeding 10%) and a temperature not substantially below that of said liquid stream.

It has been found that the preferred angle of injection, for most effective mixing results, is as set forth by Hosoi et al. in their U.S. Pat. No. 3,855,339, i.e. between 120 and 150 degrees to the downstream axis of flow of the hot gaseous combustion product stream. The most preferred angle of about 135 degrees has also been confirmed.

It has been found that, whereas a number of gases may be employed as the protective shroud gas, best overall process results have been attained by the employment of steam as the shroud gas.

Data and calculations have shown probable penetration increases of the order of about 8% caused by additional momentum flux on the order of 2% which was provided by a gas shroud. It is believed that momentum flux ratio is the important variable. In cases of high concentration liquid loading, as employed herein, the gas accelerates the liquid particles and, in effect, increases liquid particle momentum and, therefore, penetration. Thus, gas shroud enhancement of liquid penetration, if the gas shroud momentum is supplied at a sufficiently high level, assists the liquid as it attempts to penetrate a cross-flowing gas stream.

It is believed that a maximum benefit will be derived from small shroud areas, indicating:

$$\bar{Q} \simeq \bar{q}\left[1+\left(\frac{\dot{m}_g}{\dot{m}_L}\right)\left(\frac{U_g}{U_L}\right)\right]$$

wherein:

$\bar{Q}$ = shrouded dynamic pressure ratio (dimensionless)

$\bar{q}$ = unshrouded dynamic pressure ratio of injected liquid to oncoming gas (dimensionless)

$\dot{m}_g$ = gas shroud flow rate (lbs/sec.)

$\dot{m}L$ = liquid flow rate (lbs/sec.)

Ug = gas velocity (ft/sec.)

UL = liquid velocity (ft/sec.)

This also generates a relatively large gas velocity, $U_g$, for a given gas shroud flow rate, $\dot{m}_g$. Shroud gas velocities larger than 250 ft/sec. are recommended. Furthermore, it should be noted that the above is consistent with penetration (liquid into gas) literature, in that $\bar{Q} = \bar{q}$ when $\dot{m}_g = 0$.

Accordingly, the dynamic pressure ratio, $\bar{q}$, which controls liquid penetration into a cross-flowing gas, can be adjusted to an even higher level, $\bar{Q}$, when a gas shroud is included and operated appropriately. The critical advantage provided by the gas shroud is that the liquid drops either (a) attain an additional amount of momentum and/or (b) retain their originally imparted momentum longer, both of which increase the liquid penetration into the cross-flowing gas stream. The gas shroud momentum can be adjusted by altering the gas mass flow rate, the gas velocity, the shroud flow area, or the gas density. It is felt that the shape of the shroud should match that of the liquid nozzle orifice so as to circumscribe the entire liquid spray.

The method of the invention will now be more fully described with reference to the appended drawings and following data.

Figure 3A:
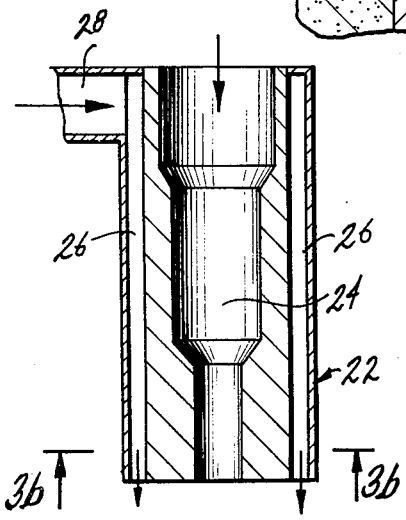
Figure 3B:
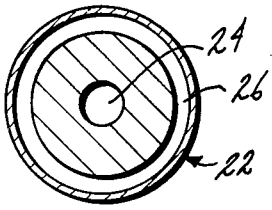
Figure 4A:
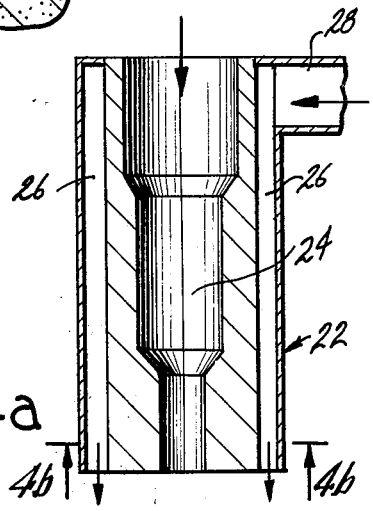
Figure 4B:
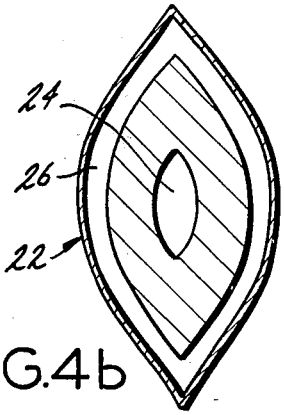

FIGS. 3*a* and 3*b* are, respectively, sectional elevational and cross-sectional schematic views of liquid injection nozzles employable in the practice of the method of the invention; and FIGS. 4*a* and 4*b* are, respectively, sectional elevational and cross-sectional schematic views of modified injection nozzles employable in the practice of the method of the invention.

Figure 1:
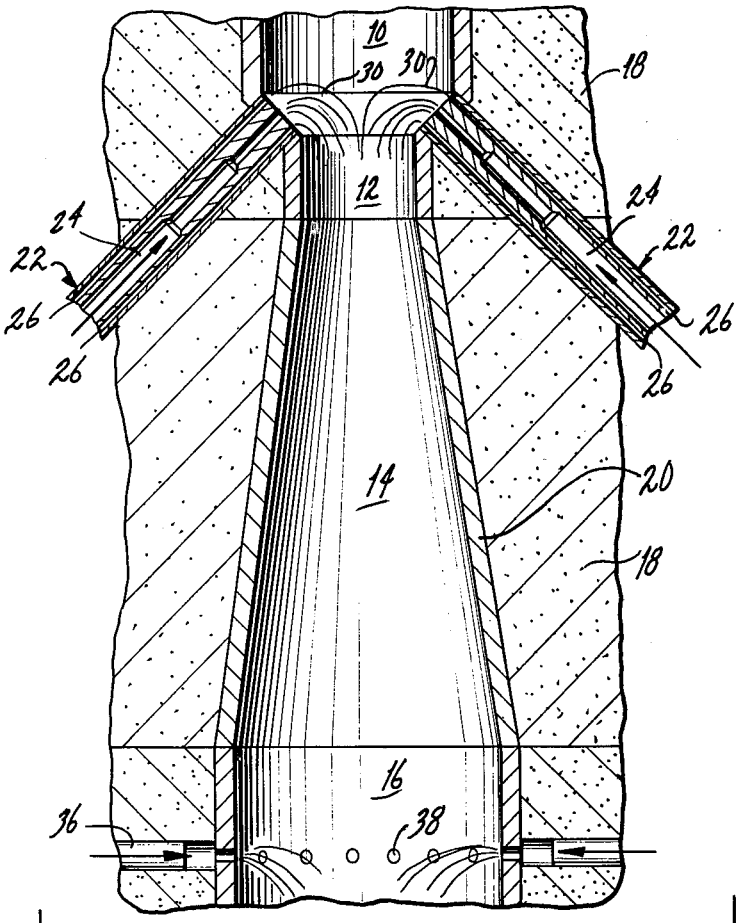
FIG. 1 is a partial sectional schematic view of the combustion burner, reactor and quenching zones of apparatus suitable for practicing the process for the thermal cracking of hydrocarbons according to the invention.

Referring specifically to FIG. 1 of the drawings, the apparatus shown comprises a combustion zone 10 which communicates through a throat section zone 12 with an outwardly flaring reaction zone 14. A quenching zone 16 is positioned at the downstream end of reaction zone 14. This three-stage series of treatment zones is contained in apparatus which is constructed of refractory material 18 having inner refractory zone wall linings 20.

Positioned in the tapering base portion of combustion zone 10 are a plurality of liquid phase injection nozzles 22. The nozzles are positioned around the periphery of the combustion zone 10 which is preferably circular in cross-section, as are the other zones of the apparatus.

The liquid phase injection nozzle 22 has a stepped, circular central passage 24 for the flow of liquid hydrocarbon feedstock to be cracked in the ACR process. An annular passage 26 surrounds the central passage 24 and provides for the flow of the annular shroud stream of gas, such as steam, which is discharged from the nozzle around the feedstock stream.

The inlet streams of feedstock and protective gas are preheated (not shown) to the desired temperature before feeding to the liquid injection nozzles 22.

Figure 2:
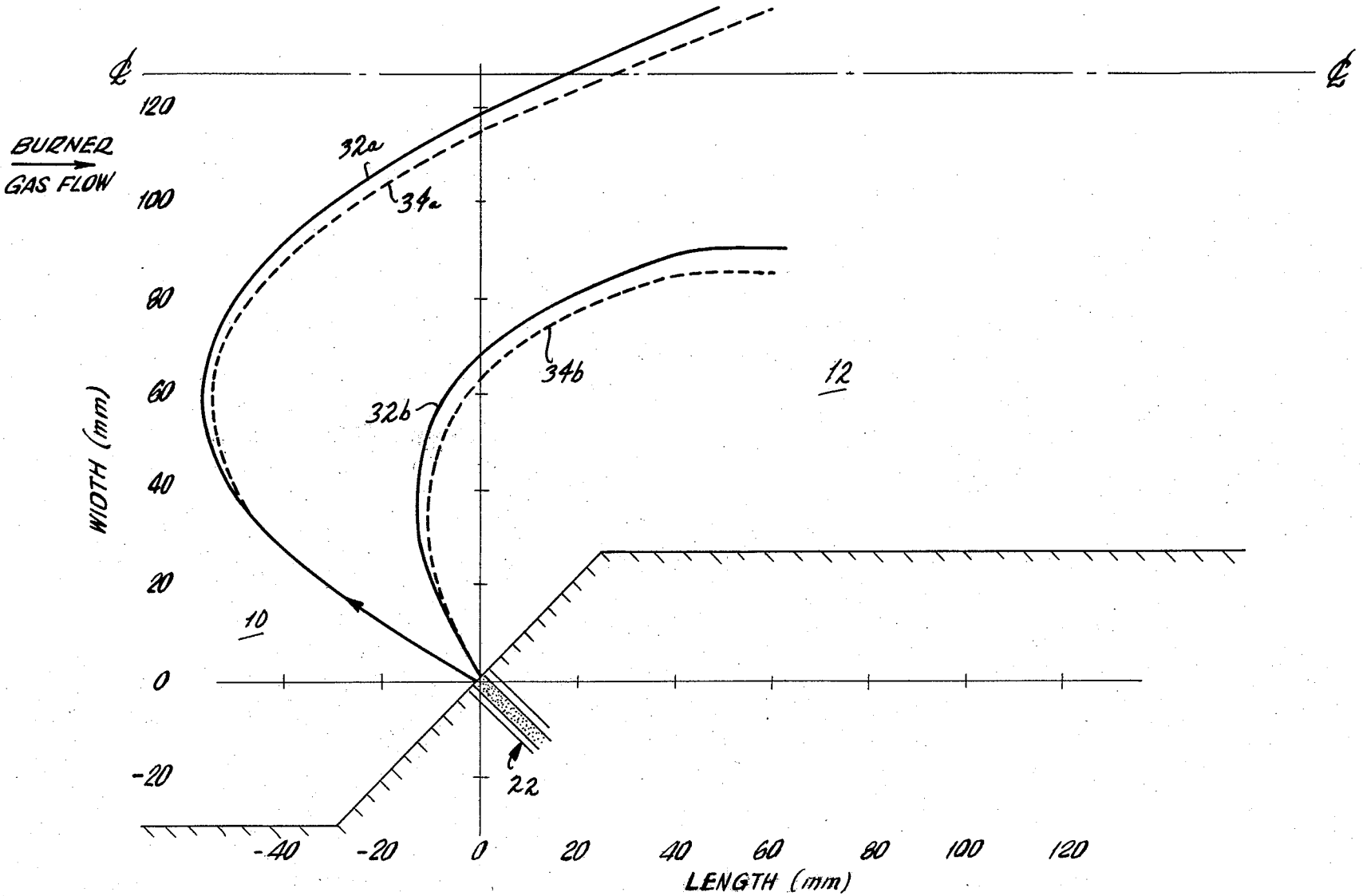
FIG. 2 is a schematic graphical representation of a portion of the combustion and reaction zones of apparatus suitable for practicing the process for the thermal cracking of hydrocarbons according to the invention.

Upon ejection of the streams 30 from nozzle 22, the shrouded streams of feedstock are injected into the hot gaseous combustion product stream (burner gas) passing from combustion zone 10 to the mixing throat zone 12 where initial mixing is effected. The ejected streams 30, upon entry into the stream of hot gaseous combustion products, are subjected to the momentum effect of the latter stream and are bent or curved in the manner shown in FIG. 2 of the drawings.

As there shown, the unitary stream of shrouded liquid feedstock ejected from nozzle 22 follows an outwardly-flaring, curved area trajectory defined, in one case, as the area between curves 32*a* and 32*b*. It is to be noted that the major portion of the injected stream does not significantly penetrate the hot gaseous combustion products stream beyond the point of the center line of the combustion zone 10 or mixing throat zone 12 sections. For another set of injection conditions of slightly lower shrouded liquid stream momentum, the dotted set of curves 34*a* and 34*b* define the area over which injection is effected. It is to be noted that curvature is more extreme due to the effect of the higher momentum hot combustion product stream relative to the liquid stream momentum.

As shown is FIG. 1, the quenching fluid is introduced into the quenching zone 16 through inlet conduits 36 which discharge through ports 38.

The liquid injection nozzle 22, shown in FIGS. 3*a* and 3*b* of the drawings, have a stepped, central liquid feedstock conduit 24 and outer, annular gas conduit 26 which is supplied through inlet conduit 28. In the embodiment of nozzle of FIGS. 4*a* and 4*b*, the nozzle body, central conduit 24 and outer, annular protective gas conduit 26 are all fan-shaped and produce a flatter ejected stream than that of the embodiment of FIGS. 3*a* and 3*b*.

It is to be noted that the stepped-taper of the central liquid feedstock passage of the nozzles of the embodiments of the drawings cooperates with other internal passage features in a manner known to those skilled in the art, to provide a swirl flow of the liquid through and from the passage. This swirl flow hs been found to be beneficial in obtaining more efficient later mixing of the liquid in the hot gaseous combustion product stream after injection therein.

Examples of the practice of the method of the present invention for enhancing the penetration in fluid mixing in a thermal hydrocarbon cracking process are set forth in the following TABLE I.

TABLE I

| Run No. | $P_t$ (psia) | $P_\infty$ (psia) | $P_\infty/P_t$ | $P_{inj}$ (psig) | % Flow - Gas Shroud Rotometer |
|---|---|---|---|---|---|
| 1 | 25.19 | 14.78 | 0.59 | 1370 | None - % |
| 2 | 25.29 | 14.90 | 0.59 | 1370 | 29.0% (at 19° C, 30.6 psig) |
| 3 | 25.29 | 14.89 | 0.59 | 1371 | 34.1% (at 19° C, 40.5 psig) |

In each of the three Runs set forth in TABLE I the same liquid injection nozzle was employed with the same injection angle, normal to the downstream axis of flow of the hot gaseous combustion products stream. The same nozzle was employed in each case and had the following characteristics:

Swirl type

Central orifice diameter, $D_o = 0.079$ inches

Discharge coefficient (dimensionless) $C_d = 0.70$

Angle of flare of spray, $\theta = 23.01°$

It is to be noted that, within less than one percent, $P_\infty/P_t$ and $P_{inj}$ are constant for all three Runs. This means that the cross-flowing gas flows and liquid flows are the same and that the only difference is in penetration resulting directly from the effect of the gas shroud.

In Run No. 1 the injected liquid is unshrouded, while in Runs Nos. 2 and 3 the liquid streams are shrouded to varying degrees of shroud pressure in supplementing of the liquid streams of substantially the same pressure.

The following TABLE II sets forth the data for calculation of the unshrouded dynamic pressure ratios ($\bar{q}$) as obtained in all three Runs set forth in TABLE I.

TABLE II

| | |
|---|---|
| Run Nos. 1, 2 and 3 | |
| $P_\infty/P_t$ | = 0.59 |
| $P_{inj}$ | = 1370–1371 |
| $T_{total}$ | = 298° K |
| $T_{test}$ | = 255.9K |
| Mach No. | = 0.91 |
| Speed of Sound | = 1051 ft/sec. |
| Gas Velocity | = 954 ft/sec. |
| q gas | = 8.51 psia |
| q liquid | = 671 psia |
| q dynamic pressure ratio | = 79 |

The following TABLE III sets forth, for each of the three Runs of TABLE I, the penetration distance for two pre-selected downstream distances for each of the Runs. It is to be noted that the origin of the distance measurements is located at the nozzle orifice and that maximum spray penetration data was obtained from spark shadow photographic data. The increase in penetration distance and resulting effective mixing obtained for the Runs in sequence may be seen from the data in TABLE III wherein the unshrouded penetration of Run 1 is exceeded by the shrouded, higher momentum stream of Run 2 and, in turn, further exceeded by the shrouded still higher momentum stream of Run No. 3.

TABLE III

| Run No. | Downstream Distance (mm) | Penetration Distance (mm) |
|---|---|---|
| 1 | 60 | 81.00 |

TABLE III-continued

| Run No. | Downstream Distance (mm) | Penetration Distance (mm) |
|---|---|---|
| 1 | 120 | 103.23 |
| 2 | 60 | 85.36 |
| 2 | 120 | 106.09 |
| 3 | 60 | 90.27 |
| 3 | 120 | 106.91 |

The following calculations set forth below for the two shrouded Runs (Run Nos. 2 and 3) of TABLE I quantify the improvement in shrouded dynamic ratios for each of these Runs.

CALCULATIONS

Basis: Rotometer equivalent flow at 100% (scfh) = 1150 $ft^3/hr$
Run 2 $0.29 \times 1150 = 333.50$ equivalent flow at 29%
Run 3 $0.341 \times 1150 = 392.15$ equivalent flow at 34.1%

$$Q_s\,(\text{scfh}) = \frac{\text{equivalent flow (scfh)}}{\sqrt{\dfrac{14.7}{14.7 + \text{psig}}}\ \sqrt{\dfrac{460 + {}^\circ\text{F}}{530}}}$$

Run 2 $Q_s = 587.56$ scfh at 19° C, 30.6 psig
Run 3 $Q_s = 762.65$ scfh at 19° C, 40.5 psig $$Q(\text{cfh}) = \left(\frac{14.7}{14.7 + \text{psig}}\right)\left(\frac{460 + {}^\circ\text{F}}{530}\right)Q_s$$

Run 2 $Q = 189.30$ cfh
Run 3 $Q = 201.64$ cfh
Outer shroud diameter, $D_{so} = 0.361$ inch. = 9.17 mm
Outer nozzle diameter (inner shroud diam.), $D_{SI} = 7.5$ mm Cross-sectional shroud area, $A_s = \frac{\pi}{4}(D_{so}^2 - D_{SI}^2) = 21.86\ mm^2$ $$U\,(\text{ft/sec}) = \frac{Q\,(100)\,(2.54^2)\,(144)}{(21.86)\,(3600)}$$

Run 2 $U = 223.47$ ft/sec
Run 3 $U = 238.04$ ft/sec
Run 2 $\rho(lb/ft^3) = 0.23$ at 19°C., 30.6 psig } from ideal
Run 3 $\rho(lb/ft^3) = 0.28$ at 19°C., 40.5 psig } gas law $$\dot{m}_g\,(\text{lb/sec}) = \frac{\rho U A_s}{(100)\,(2.54^2)\,(144)}$$

Run 2 $\dot{m}_g = 0.0121$ lb/sec
Run 3 $\dot{m}_g = 0.0157$ lb/se
$\dot{m}_L = 0.665$ lb/sec $$U_L = \frac{\dot{m}_L}{\rho_L A_L} = \frac{(0.665)\,(4)\,(144)}{(61.9)\,\pi\,(0.079^2)} = 315.61\ \text{ft/sec}$$

Estimated effect: $\bar{Q} \simeq \bar{q}\left[1 + \frac{\dot{m}_g}{\dot{m}_L}\ \frac{U_g}{U_L}\right]$ Run 2 $\bar{Q} \simeq 1.0129\,\bar{Q}$ Run 3 $\bar{Q} \simeq 1.0178\,\bar{q}$

DEFINITION OF SYMBOLS $P_t$ = cross-flow (on-coming) gas stagnation or total pressure, psia
$P\infty$ = cross-flow gas static pressure at spray injection location, psia
$P_{inj}$ = liquid spray injection pressure, psig
$T_{total}$ = cross-flow gas stagnation or total temperature, ° K.
$T_{test}$ = cross-flow gas temperature at spray injection location, ° K.
$q_{gas}$ = cross-flow dynamic pressure, psia
$q_{gas} = [\frac{1}{2}\rho V^2]_{gas} = P\infty\ M\ (\gamma/2)$ where
$\gamma$ = cross-flow gas specific heat ratio
M = cross-flow gas mach number
$q_{liquid}$ = liquid spray dynamic pressure, psia
$q_{liquid} = [\frac{1}{2}\rho V^2]_{liquid} = Cd^2 P_{inj}$ where Cd = liquid spray injector nozzle discharge coefficient
$\bar{q}$ = unshrouded dynamic pressure ratio—$q_{liquid}/q_{gas}$
$\bar{Q}$ = shrouded dynamic pressure ratio (as defined above)
$Q_s$ = volumetric flow rate of shroud gas at standard temperature and pressure ($ft^3/hr$)
Q = volumetric flow rate of shroud gas at the test temperature and pressure ($ft^3/hr$)
U = linear shroud gas velocity (ft/sec)
$\rho$ = shroud gas density ($lb/ft^3$)
$A_s$ = area of shroud gas annulus
$\dot{m}_g$, $\dot{m}_L$ = mass flow rate of shroud gas and liquid spray, respectively (lb/sec)
$U_L$ = linear liquid spray velocity (ft/sec)
$\rho_L$ = liquid density of spray ($lb/ft^3$)
$A_L$ = orifice area of liquid spray nozzle.

What is claimed is:

1. In the thermal cracking of hydrocarbons by the introduction of liquid petroleum feedstock into a stream of hot gaseous combustion products formed by the combustion of fluid fuel and oxidant in the presence of steam, in apparatus having a combustion/mixing zone and a reaction zone downstream therefrom, the method comprising introducing and mixing said liquid as at least one stream countercurrently into said hot gaseous combustion product stream while concurrently surrounding and shrouding each of said liquid streams with a co-injected annular stream of gas having a velocity sufficient to supplement momentum and a temperature not substantially below that of said liquid stream, thereby enhancing penetration of and mixing with said hot combustion product stream.

2. The method in accordance with claim 1, wherein at least one liquid stream is injected into said hot gaseous combustion product stream at an angle of injection between about 120 and 150 degrees to the downstream axis of flow of said hot gaseous combustion products stream.

3. The method in accordance with claim 2, wherein said angle of injection is about 135 degrees.

4. The method in accordance with claim 1, wherein said gas is steam.

5. In the thermal cracking of hydrocarbons by the introduction of liquid petroleum feedstock into a stream of hot gaseous combustion products formed by the combustion of fluid fuel and oxidant in the presence of steam, in apparatus having a combustion zone, a mixing throat zone, and a reaction zone downstream therefrom, the method comprising introducing and mixing said liquid immediately upstream of said mixing throat zone, as at least one stream countercurrently into said hot gaseous combustion product stream in said combustion zone, while concurrently surrounding each of said liquid streams with a co-injected annular shroud stream of gas having a velocity sufficient to supplement momentum and a temperature not substantially below that of said liquid stream, thereby enhancing penetration of and mixing with said hot combustion product stream.

6. The method in accordance with claim 5, wherein at least one liquid stream is injected into said hot gaseous combustion product stream at an angle of injection between about 120 and 150 degrees to the downstream axis of flow of said hot gaseous combustion products stream.

7. The method in accordance with claim 5, wherein said angle of injection is about 135 degrees.

8. The method in accordance with claim 5, wherein said gas is steam.

9. The method in accordance with claim 5, wherein mixing of said introduced liquid stream(s) and shroud stream(s) is initially mixed in said hot gaseous combustion product stream in said mixing throat zone and mixing is completed in said reaction zone downstream therefrom.

10. The method in accordance with claim 5, wherein said co-injected liquid and annular shroud streams are circular in cross-section.

11. The method in accordance with claim 5, wherein said co-injected liquid and annular shroud streams are fan-shaped in cross-section.

12. The method in accordance with claim 10, wherein said liquid stream is injected into said combustion zone in a swirl flow pattern.

* * * * *